US005708416A

United States Patent [19]

Zaharia et al.

[11] Patent Number: 5,708,416

[45] Date of Patent: Jan. 13, 1998

[54] WIRELESS DETECTION OR CONTROL ARRANGEMENT FOR ESCALATOR OR MOVING WALK

[75] Inventors: Vlad Zaharia, Rocky Hill; James A. Rivera, Bristol, both of Conn.

[73] Assignee: Otis Elevator Company, Farmington, Conn.

[21] Appl. No.: 704,050

[22] Filed: Aug. 28, 1996

Related U.S. Application Data

[63] Continuation-in-part of Ser. No. 430,916, Apr. 28, 1995, abandoned.

[51] Int. Cl.[6] ..... G08B 1/00

[52] U.S. Cl. ..... 340/531; 340/506; 340/539; 340/825.06; 340/825.19; 198/322; 198/323

[58] Field of Search ..... 340/531, 539, 340/506, 532, 825.06, 825.52, 825.69; 455/129; 198/322, 323

[56] References Cited

U.S. PATENT DOCUMENTS

| | | | |
|---|---|---|---|
| 4,818,970 | 4/1989 | Natale et al. | 340/539 |
| 5,099,977 | 3/1992 | Hirose et al. | 198/323 |
| 5,107,975 | 4/1992 | Iwata | 198/323 |
| 5,186,300 | 2/1993 | Zaharia | 198/322 |
| 5,260,688 | 11/1993 | Curry et al. | 340/539 |
| 5,291,193 | 3/1994 | Isobe et al. | 340/825 |
| 5,295,567 | 3/1994 | Zaharia et al. | 198/323 |
| 5,448,220 | 9/1995 | Levy | 340/539 |
| 5,526,256 | 6/1996 | Sakata et al. | 364/184 |

FOREIGN PATENT DOCUMENTS

| | | |
|---|---|---|
| 3158388 | 7/1991 | Japan . |
| 4125293 | 4/1992 | Japan . |
| 570076 | 3/1993 | Japan . |
| 5139679 | 6/1993 | Japan . |

OTHER PUBLICATIONS

"Digital Wireless Networks", by John Gallant, EDN–Special Report, Communications Technology, Mar. 4, 1993, p. 78.

"ICs and Modules for digital Wireless Telecommunications", by John Gallant, EDN–Special Report, Military Technology, Aug. 19, 1993, p. 77.

"High–Speed Bipolar Process Forms Bedrock For Wireless ICs", by Brian Kerridge, EDN Design Feature, Aug. 18, 1994, p. 66.

"Micron Subsidiaries Prep RF–ID, FED", By Loring Wirbel, Electronic Engineering Times, Aug. 1, 1994, p. 4.

Apple Leading Euro High–Speed LAN Effort, by Roger Woolnough, Elect. Engr. Times, Oct. 1994.

*Primary Examiner*—Jeffery Hofsass
*Assistant Examiner*—Daryl C. Pope

[57] ABSTRACT

A control or detection arrangement for escalators, moving walks and the like includes a detector, an encoder unit connected to the detector, a wireless transmitter connected to the encoder unit, a wireless receiver, a decoder unit connected to the wireless receiver, and a microprocessor connected to the decoder unit. When an unsafe condition is detected by the detector, the encoder unit generates a trigger signal having at least one unique identifier for the detector. When received, the signal is passed by the decoder to the microprocessor which causes generation of a command signal to, for example, stop motion of the escalator. Alternatively, the inventive arrangement operates according to continuous or periodic transmission modes, which permit the arrangement to monitor operability of the detector, encoder unit, transmitter, receiver and the decoder unit.

6 Claims, 7 Drawing Sheets

WIRELESS DETECTION OR CONTROL ARRANGEMENT FOR ESCALATOR OR MOVING WALK

CROSS-REFERENCE TO RELATED APPLICATIONS

This application is a continuation-in-part of a commonly-owned patent application Ser. No. 08/430,916, filed Apr. 28, 1995 referenced under OT-2151, Zaharia, et al, entitled "Wireless Detection or Control Arrangement for Escalator or Moving Walk" which is now abandoned. This application is also related to commonly-owned patent application Ser. No. 08/405,475, filed Mar. 16, 1995, referenced under OT-2127, Zaharia, et al, entitled "Detection of Escalator Safety Circuit Component Operability" which is now U.S. Pat. No. 5,601,178.

TECHNICAL FIELD

The present invention relates to detection or control arrangements and, particularly, to such arrangements for escalators, moving walkways or other movers which may carry passengers or cargo.

BACKGROUND OF THE INVENTION

Escalator safety devices include mechanical limit switches and electronic sensors connected such that actuation of a device stops the escalator in accordance with various safety requirements. The safety devices are wired to an escalator controller using terminal blocks, junction boxes, cables, conduits, etc. See FIG. 6 and also, for example, U.S. Pat. No. 5,186,300, Starting Circuit and Method for Escalators and Moving Walks, Feb. 16, 1993, by Zaharia. Therefore, the cost of an escalator increases in proportion to the number of safety devices and optional features, such as fault finders, because of the wiring of these devices and features to the escalator controller.

DISCLOSURE OF THE INVENTION

The present inventors believe that eliminating wiring between the controller and the safety devices would significantly reduce the cost of manufacturing an escalator. Also, this elimination would greatly simplify the process of connecting or adding a new switch, sensor or other safety device.

The detection/control arrangement according to the present invention includes a wireless, e.g., radio frequency (RF) transmit and receive system to detect actuation of safety devices contained, e.g., in an escalator or moving walk or the like. Each limit switch, electronic sensor or other detector is connected to a respective "local" encoder (ENC) which is connected to a respective transmitter (XMTR). Preferably, ENC and XMTR are battery powered. The battery powered ENC-XMTR apparatus may be similar to key-chain transmitters for automobile door locks or transmitters for garage door openers.

In a preferred embodiment, the encoder is programmed to generate a sequence of '1's and '0's that uniquely identifies a particular escalator, switch sensor and/or other detector. The transmission sequence or signal packet includes a code portion that uniquely identifies, for example, each escalator of a plurality of escalators within the same building. This ensures that actuation of a safety device stops only the escalator to which that device belongs. Programming the unique identifier is accomplished, for example, by a series of DIP (dual-in-line package) switches or other means, such as EPROM (erasable programmable read-only memory, Flash EPROM, etc.). An optional "LOW BATTERY" signal in the signal packet identifies which device is affected and allows various system responses, such as prevent re-starting until the battery is replaced.

When a switch, sensor or other detector is actuated, XMTR transmits the sequence or packet associated with that safety device. A receiver (RCVR), connected to and preferably located at the escalator controller, receives the signal and a decoder (DEC) identifies the safety device by comparing the transmitted sequence with a "library" of prestored sequences. If a transmitted sequence matches a prestored sequence, the encoder passes the packet or generates another suitable signal to an escalator controller. The controller (e.g., microprocessor based) then stops the escalator as required.

As a further option, a wireless service and maintenance unit (e.g., hand-held) identifies the safety device actuated and the escalator to which the device belongs.

In further optional aspects of the invention, the arrangement operates in a continuous transmission mode or periodic transmission mode to monitor operability of each safety device and other portions of the arrangement.

The present inventors believe that a detector/control arrangement according to the invention has at least the following advantages:

- Wiring between controller and safety devices is eliminated;
- Applicable to modernization installations (simplified process of adding new devices);
- Has dual usage: escalator control and/or "stand-alone" fault finder;
- Permits wireless remote monitoring (each device or detector is uniquely identifiable) using building central station or hand-held service and maintenance device or remote monitoring station outside of a building, and
- Could be used on low rise elevators (e.g., hydraulic).

Accordingly, it is a principal object of the present invention to reduce cost in producing electronic control arrangements.

It is a further object of the present invention to reduce cost in manufacturing escalators or other people movers.

It is an additional object of the present invention to simplify the addition of safety devices to escalators or to other people movers.

It is a still further object of the present invention to enhance safety in escalators or other people movers.

Further and still other objects of the present invention will become more readily apparent in light of the following detailed description when taken in conjunction with the following drawing, in which:

BEST MODE FOR CARRYING OUT THE INVENTION

Figure 1:
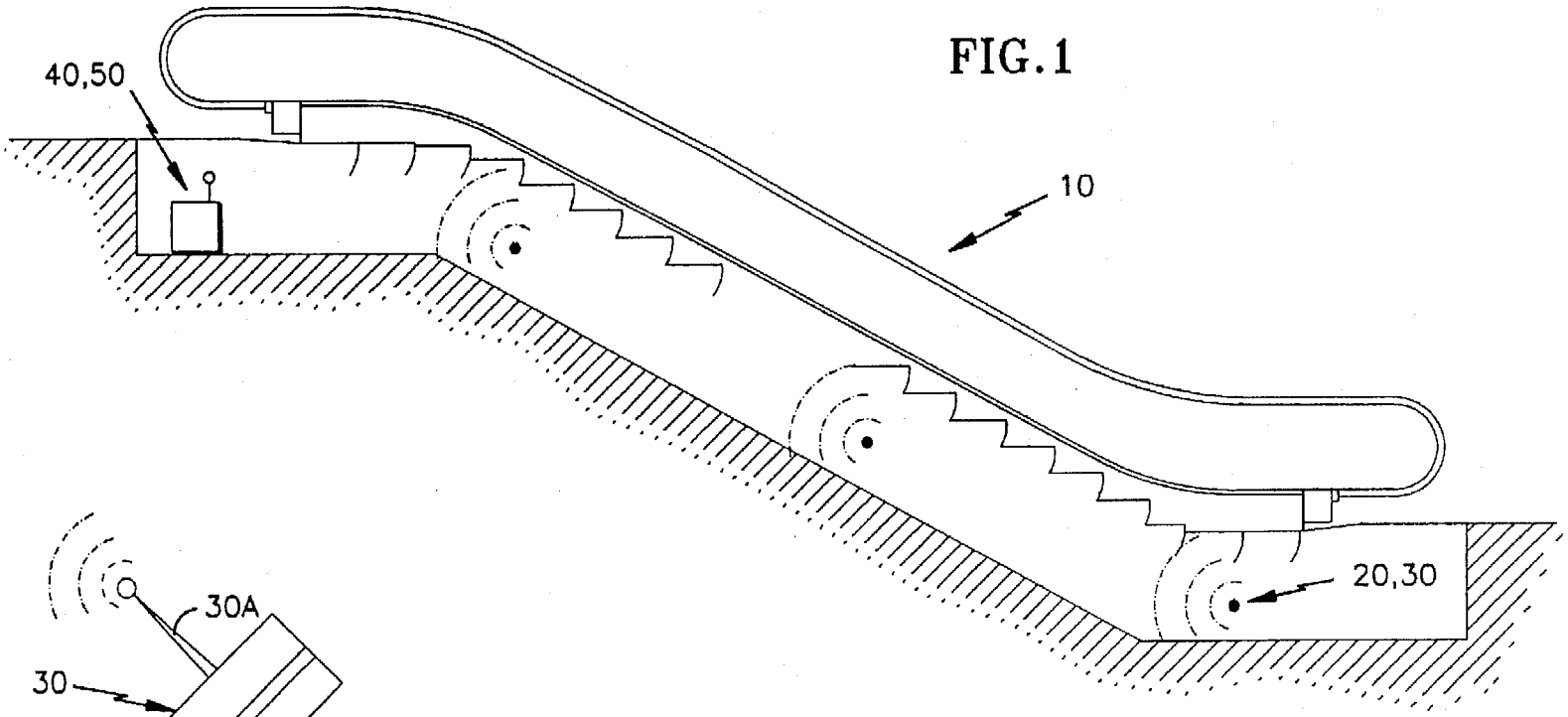
FIG. 1 is a side schematic diagram of an escalator including a detection/control arrangement according to the present invention.

Referring to the figures, and FIG. 1 in particular, there is shown an escalator 10 including a detection/control arrangement according to the present invention. The detection/control arrangement includes a safety device 20 connected to an encoder-transmitter 30, and a controller 40 connected to a receiver-decoder 50.

Figure 1A:
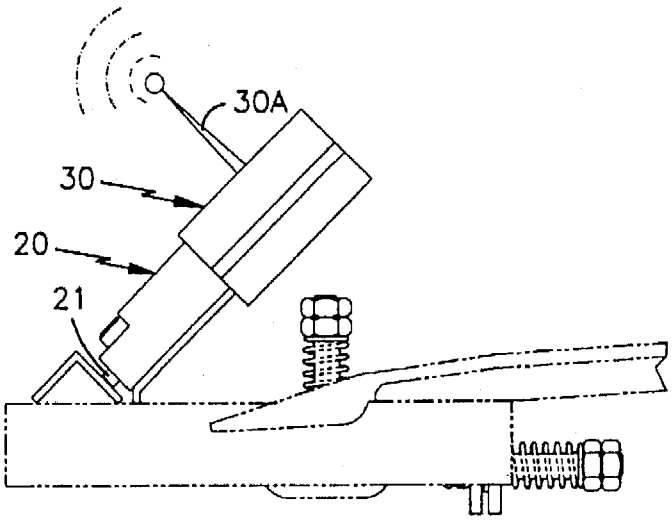
FIG. 1A is a side schematic view of a detail showing a safety device (detector) and an encoder-transmitter of FIG. 1.
Figure 3:
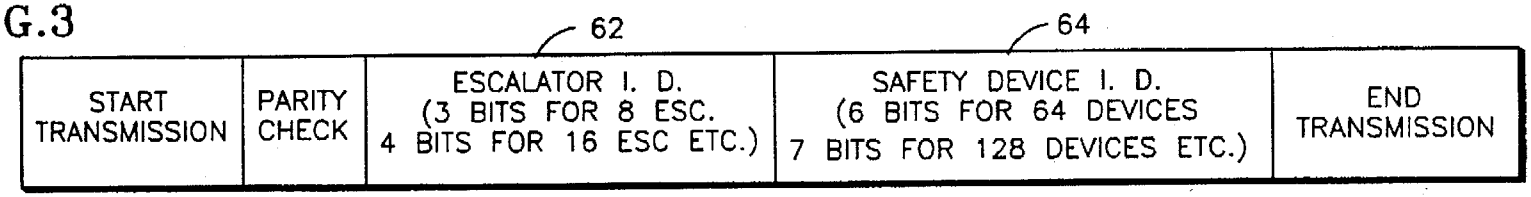
FIG. 3 is a schematic diagram showing a typical signal packet according to the invention transmitted by the encoder-transmitter of FIG. 2.

FIG. 1A shows a conventional electro-mechanical safety device 20 connected to an encoder-transmitter 30 such that actuation of the device 20 by a button 21 (e.g., because of an unsafe condition) causes the encoder-transmitter 30 to transmit a digitized trigger signal packet from an antenna 30A. A preferred trigger signal packet 60 is shown in FIG. 3. According to an essential aspect of the invention, the packet includes at least one (or both) unique identifier(s) such as an escalator ID portion 62 and/or a safety device ID portion 64. Preferably, the packet 60 includes both identifiers 62, 64 so that not only the particular escalator (e.g., 10) but also the particular device (e.g., 20) are identified and necessary for the receiver-decoder 50 to pass the packet 60 or other suitable signal to the controller 40. Upon receiving the packet 60, the controller 40 causes, for example, the escalator 10 to stop its motion and remain stopped until the device 20 is reset—indicating that an unsafe condition is no longer present.

Operation of escalator safety devices is taught, for example, in U.S. Pat. No. 5,186,300, and also in U.S. patent application Ser. No. 8/405,475, filed Mar. 16, 1995, Detection of Escalator Safety Circuit Component Operability, Zaharia et al, both assigned to Otis Elevator Company and both incorporated herein by reference in their entireties.

Figure 5:
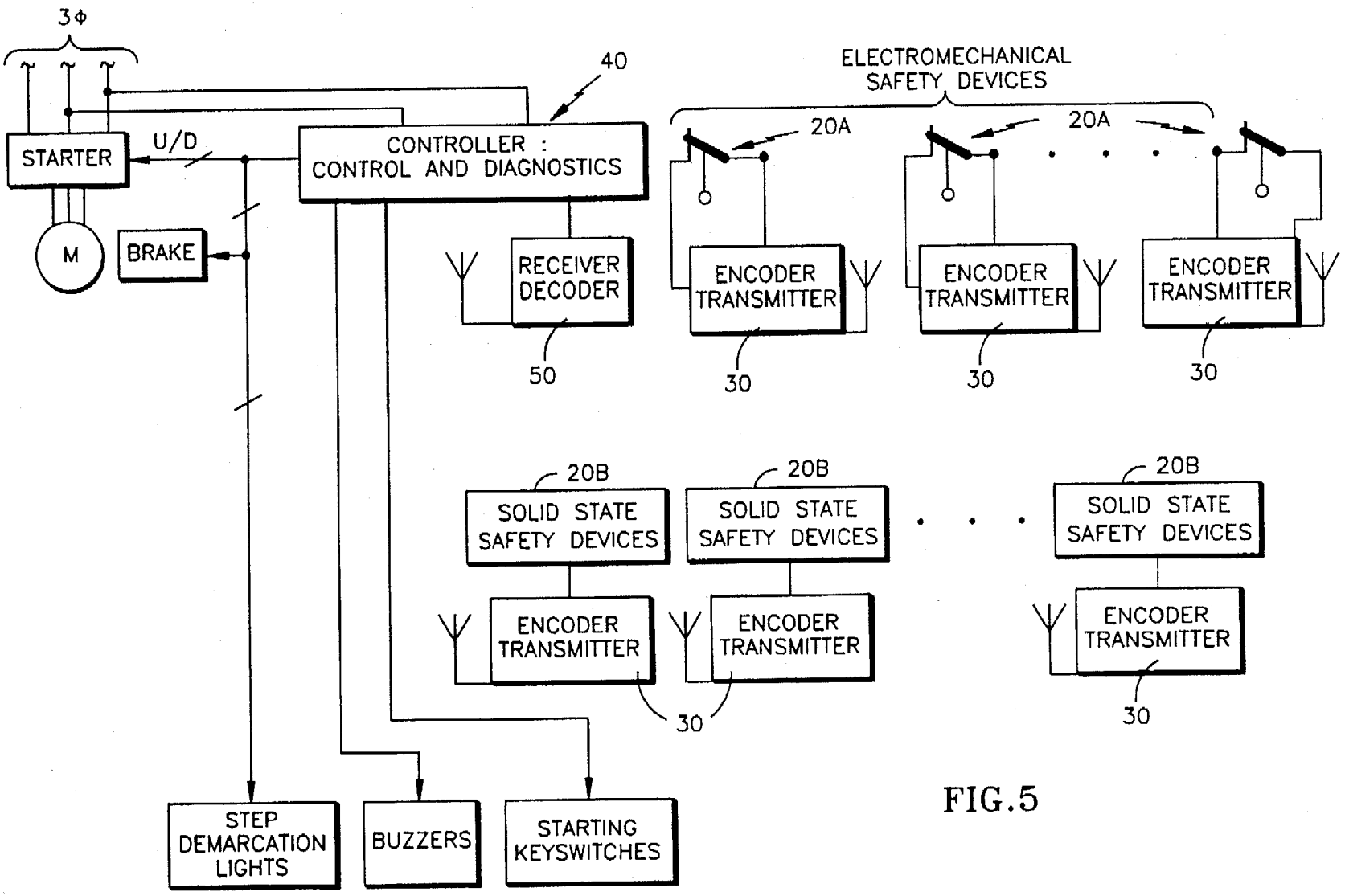
FIG. 5 is a schematic circuit diagram of an escalator including a wireless detection/control arrangement of the present invention.
Figure 6:
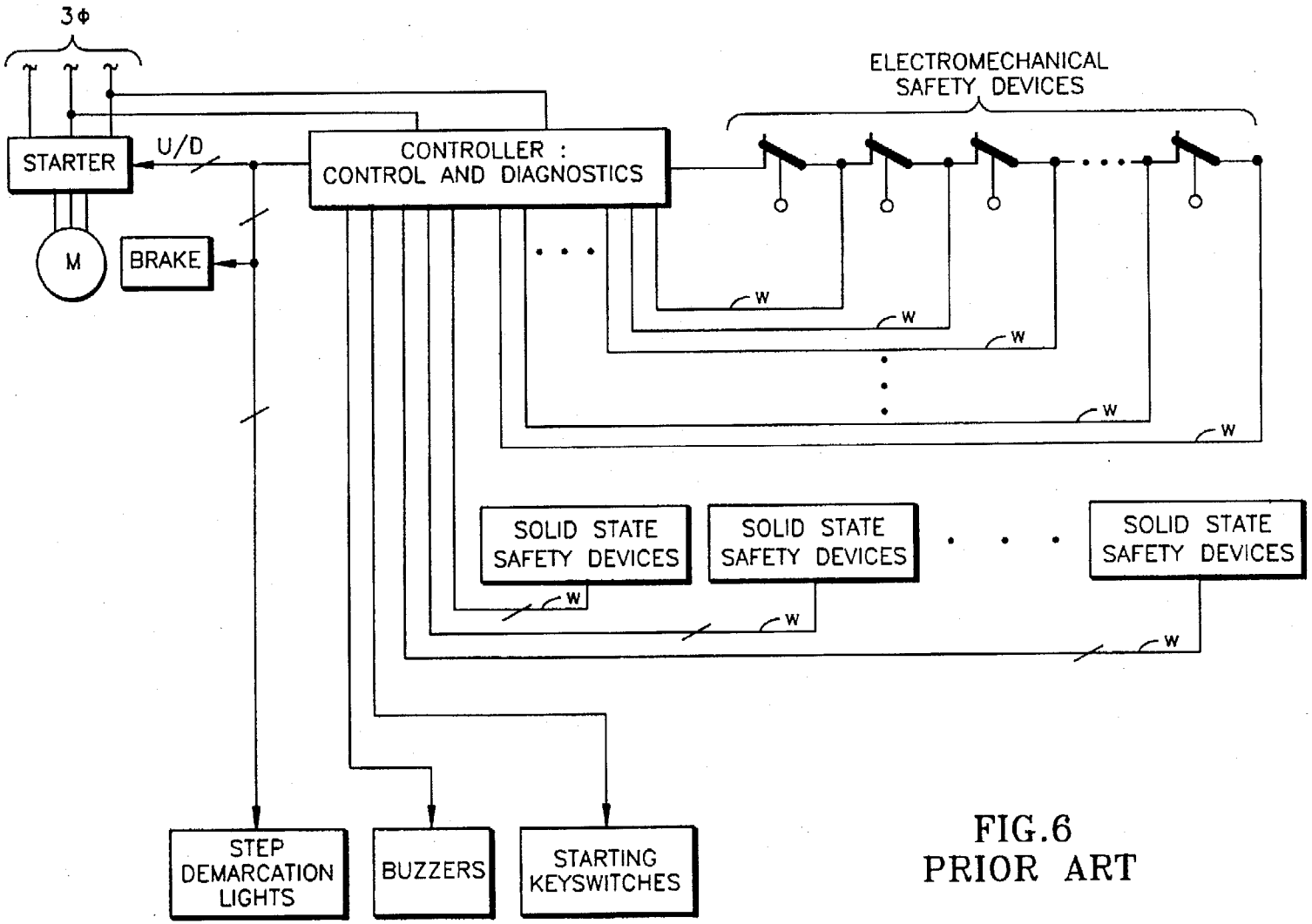
FIG.6 PRIOR ART
FIG. 6 is a schematic circuit diagram of an escalator including a wired detection/control system according to the prior art.

FIG. 5 shows an escalator control arrangement for the escalator 10 which includes, according to the invention, a plurality of encoder-transmitters 30 connected to electro-mechanical safety devices 20A and to solid state safety devices 20B, and a receiver-decoder 50 connected to a controller 40.

Figure 2:
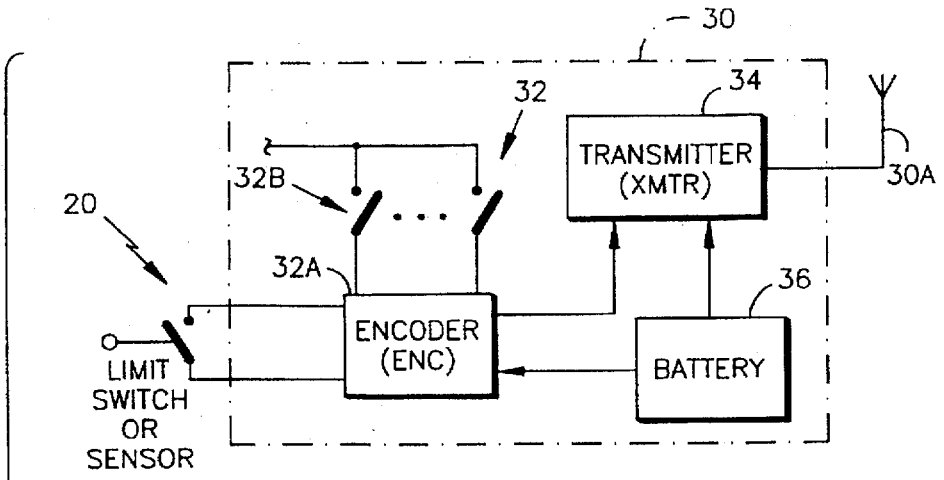
FIG. 2 shows block schematic circuit diagrams of a preferred detection/control arrangement according to the present invention.

Preferred embodiments of the encoder-transmitters 30 and of the receiver-decoder 50 are shown in the block schematic circuit diagrams of FIG. 2. A switch, sensor or other detector 20 is suitably, e.g. electrically, connected to an encoder unit 32 including an encoder 32A connected to DIP switches 32B for generating at least one unique identifier (e.g., ID bits) in a trigger signal (e.g., digitized) generated by the encoder 32A responsive to a signal generated from the detector 20 upon the occurrence, for example, of an unsafe condition in the escalator 10. Of course, other suitable memories such as a ROM, EEPROM, etc. can be used in lieu of the DIP switches 32B. The trigger signal 60 containing at least one of the unique identifiers 62, 64 is passed to an RF transmitter 34. The transmitter 34 transmits the signal 60 via an antenna 30A to an antenna 50A of the receiver-decoder 50. The signal 60 is received by a receiver 54 connected to a decoder unit 52 which includes a decoder 52A coupled to a library (or memory) 52B via a bus 52C. The memory 52B stores, among other instructions and data, data which corresponds to the unique identifiers 62, 64 so that the decoder 52A will pass the trigger signal having an identifier 62, 64, but will not pass any informational signals from the receiver 54 which do not contain an identifier 62, 64.

Figure 2A:
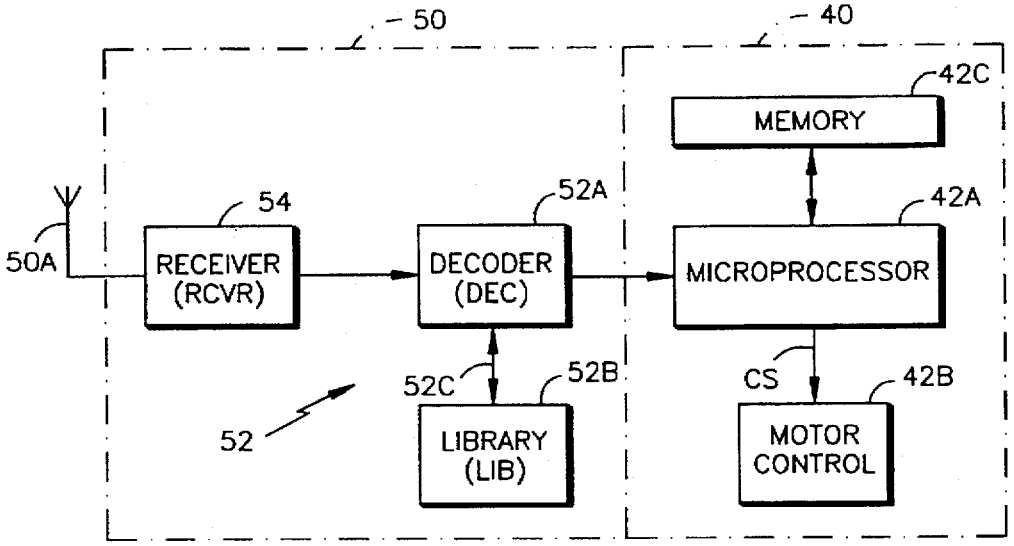
FIG. 2A is a high-level logic flow diagram of a detection/control routine of the present invention.
Figure 2A:
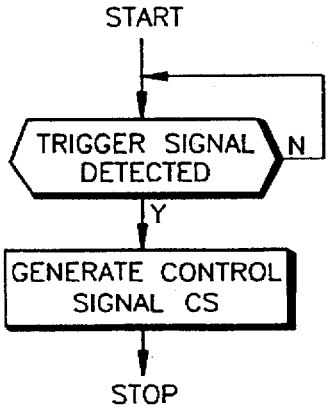

After the trigger signal 60 is passed by the decoder unit 52, the signal 60 or any other appropriate signal from the unit 52 is received by a processor 42A suitably connected (e.g., by buses) to a memory 42C (RAM, ROM, EEPROM, FLASH, etc.) which stores suitable instructions to cause the processor 42A to generate a control signal CS which controls a motor control 42B (switch, etc.) to disconnect electrical power from a motor M (FIG. 5). A routine corresponding to such suitable instructions is shown, for example, in the high-level logic flow diagram of FIG. 2A.

Various types of encoders, DIP switches, decoders, memories, RF transmitters and RF receivers are commercially available which, when combined and programmed according to the present invention, result in the preferred detection/control arrangement of FIG. 2. Also, wireless integrated circuits and modules such as those manufactured and sold by GEC Plessey Semiconductors and/or Apple Computer Europe can be utilized as bases for the elements 30, 50. The unit 30 is powered, e.g., by a battery 36. See "Digital wireless networks," EDN, Mar. 4, 1993, pg. 78, by Gallant, John and "ICs and modules for digital wireless communications," EDN, Aug. 19, 1993, pg. 77, by Gallant, John, which are both incorporated herein by reference in their entireties.

Figure 4:
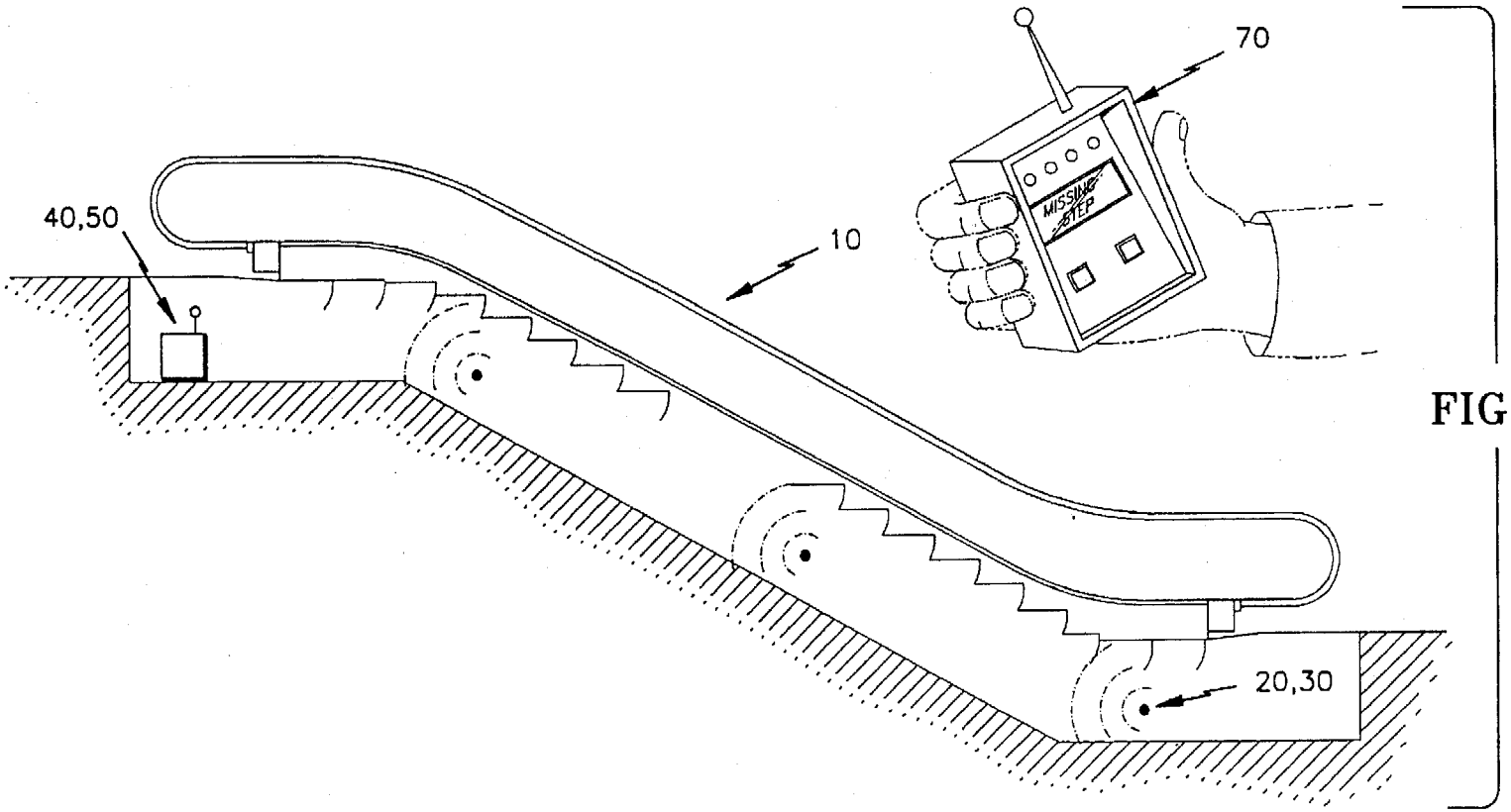
FIG. 4 is a schematic diagram of an optional hand-held feature according to the present invention.

In one optional feature of the present invention, the trigger signal 60 is received also by a portable (e.g., hand-held) receiver unit 70 (FIG. 4) which, dependent upon the particular device ID 64, can indicate and/or otherwise display condition information (e.g., missing step) when the corresponding safety device is activated. In another optional feature, instead of battery powered, each encoder-transmitter can receive electrical power from a suitable (e.g., DC) power rail (not shown) located within the escalator.

Also, in an alternative aspect of the invention, each encoder-transmitter 30 may operate according to a continuous transmission mode and, thus, may stop transmission when a safety device 20 is operated or when the safety device 20 or an encoder-transmitter 30 becomes inoperative. In another alternative aspect of the invention, each encoder-transmitter 30 may operate according to a periodic transmission mode as explained with reference to FIGS. 8, 9 and 10. Either of these aspects checks or monitors the operability of all safety devices 20, whether the escalator 10 is in motion or not. If a safety device 20 is found to be in a condition which will not allow it to operate properly in the event of an unsafe occurrence, then the control system 40 will prevent the escalator from starting up, or the system 40 will stop the escalator if the escalator is in motion.

Figure 7:
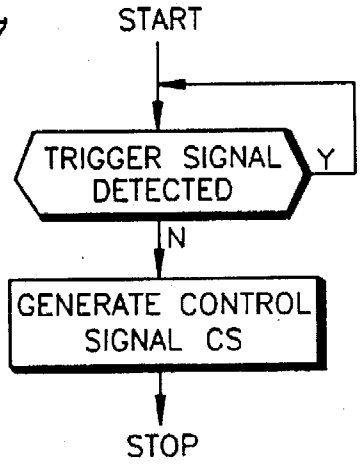
FIG. 7 is a high-level logic flow diagram of a "continuous transmission mode" detection/control routine of the present invention.

An encoder-transmitter 30 is readily configured to transmit a signal packet 60 (FIG. 3) continuously—i.e. repeatedly and consecutively without interruption during normal operation. A receiver-decoder 50 and controller 40 (FIG. 2) are readily configured (e.g., programmed, etc.) to detect an absence of the packet 60, and then to generate a control signal CS in response to detecting the absence of the packet 60; see FIG. 7.

Figure 8:
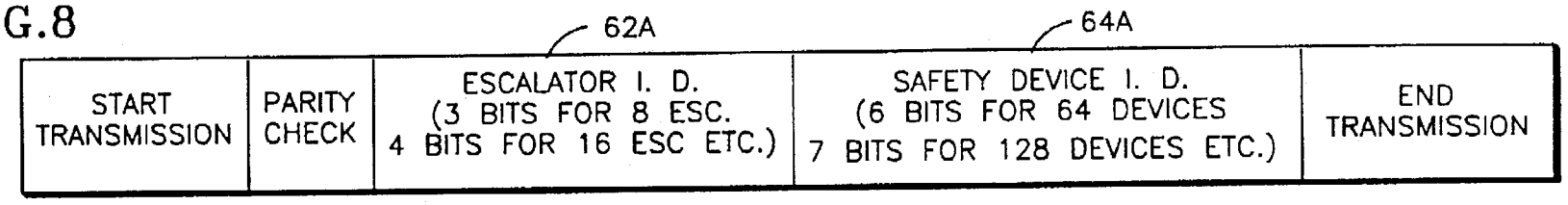
FIG. 8 is a schematic diagram showing a "device operational" signal packet of a "periodic transmission mode" of the present invention.
Figure 9:
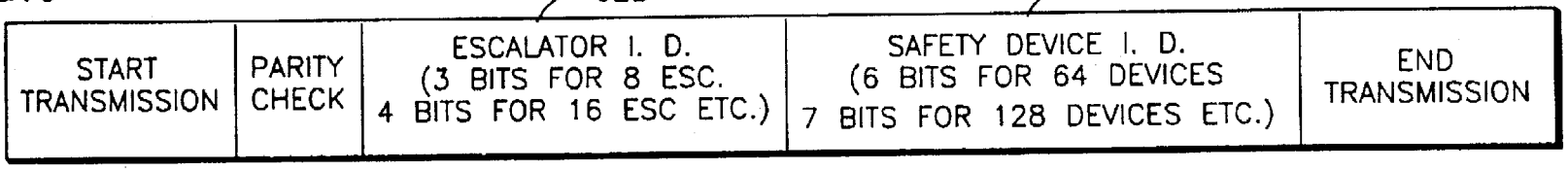
FIG. 9 is a schematic diagram showing a "device actuated" signal packet of the "periodic transmission mode."
Figure 10:
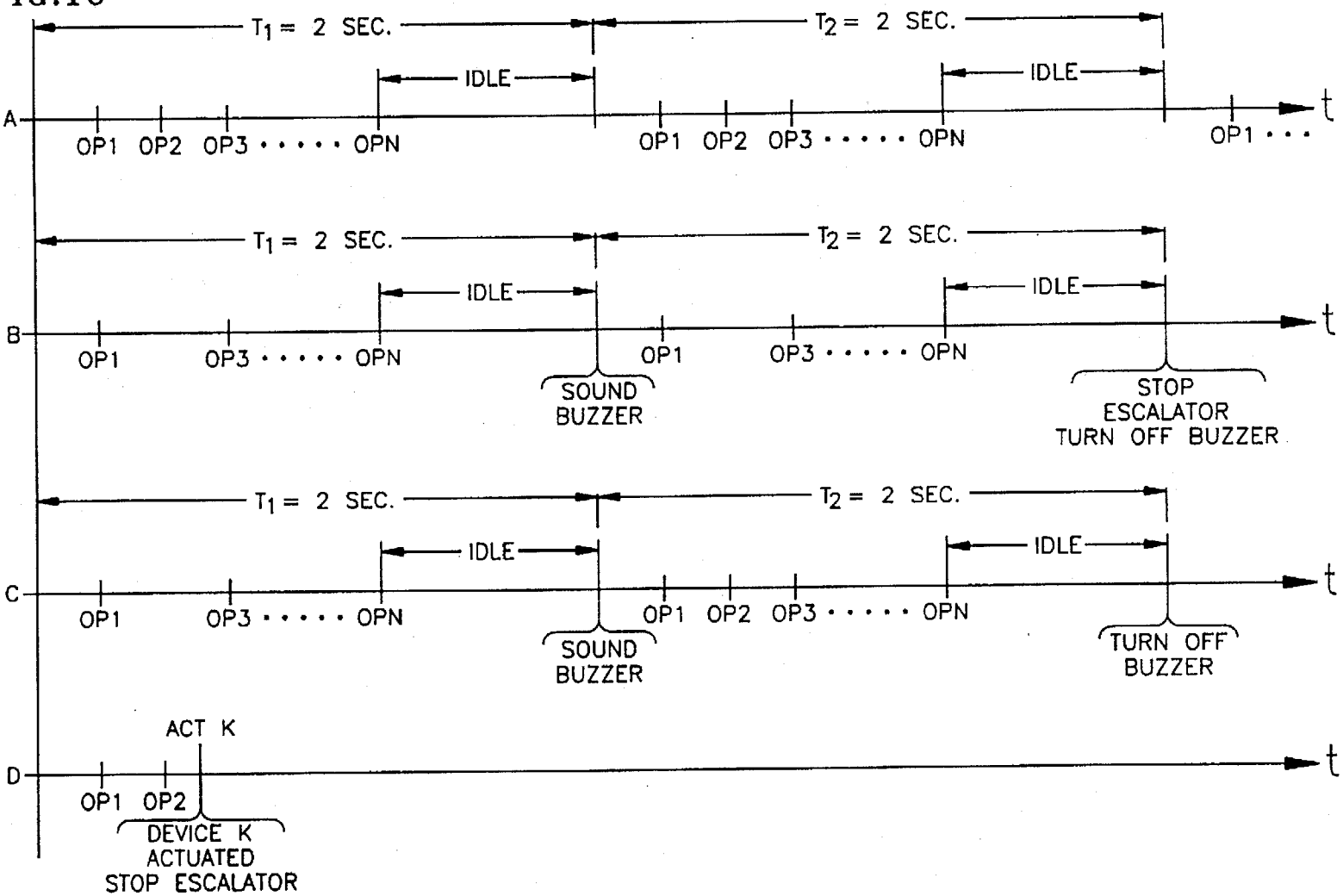
FIG. 10 is a timing diagram which explains the "periodic transmission mode" of the present invention.

Alternatively, each device 20, each encoder-transmitter 30 and the units 50, 40 are configured to operate in a periodic transmission mode (FIGS. 8, 9 and 10). Each wireless safety device 20 and encoder-transmitter 30 is configured such that, when the device 20 is not actuated by an unsafe condition, each encoder-transmitter unit 30 transmits an OPK (device ID #K is operational) signal packet 60A to the unit 50 connected to the controller 40. Each OP signal packet (FIG. 8) is transmitted with a certain periodicity, for example every two seconds, and all OP signal packets are transmitted within a certain time interval or window T (e.g., two second interval). Upon receiving OP signal packets from all safety devices 20 within a two-second window (e.g., $T_1$), the control system 40 determines that all safety devices are operational (FIG. 10, part A). Each OP signal packet (60A) is encoded (62A, 64A) such that the packet 60A identifies a unique safety device 20.

If any safety devices 20 does not transmit an OP signal packet 60A within a window (e.g., $T_1$), then the controller 40 activates an alarm buzzer and initiates a "shutdown" timing sequence. See FIG. 10. In the shutdown sequence, if the OP signal packet is still not received within the next two-second interval $T_2$, then the escalator 10 is brought to a stop. FIG. 10, part B, shows that the OP2 signal packet has not been received, indicating that a safety device 20 (e.g., ID #2) is not operational. The buzzer is mined off at the end of the "shutdown" sequence, e.g., when the escalator is stopped. If a solid state motor control 42B is used, stopping the escalator is accomplished by slowly ramping down (i.e. deceleration of not greater than 3 ft/sec$^2$) the speed of the escalator, to prevent passenger injury due to an abrupt stop. The escalator will be prevented from being re-started until all OP signal packets 60A are again received from all safety devices 20.

However, if the OP signal packet is received within the next two-second interval $T_2$, then the "shutdown" sequence is canceled and the buzzer is mined off. The escalator continues to run. FIG. 10 (part C) shows that the OP2 signal packet is received in the next two-second interval $T_2$.

In the event that all safety devices 20 are operational (i.e. all OP signal packets 60A had been received within the last two-second window), but one safety device 20 is actuated as a result of an unsafe condition, then that safety device 20 and its encoder-transmitter 30 immediately transmits an ACTK (device ID #K actuated) signal packet 60B (FIG. 9) having identifiers 62B, 64B, and the control system 40 commands the motor to stop and the brake to drop without any delay (FIG. 10, part D).

To prevent interference and to differentiate the packet 60A from the packet 60B, all OP signal packets 60A are, for example, transmitted within one frequency band while all ACT signal packets 60B are, for example, transmitted within another frequency band. A frequency band for OP signal packets 60A is, e.g., 902 MHZ–928 MHZ, while a frequency band for ACT signal packets 60B is, e.g., 2.4 GHZ–2.48 GHZ. Of course, other methods can be utilized to differentiate an OP signal packet from an ACT signal packet. For example, additional bits can be included in either the packet 60A or the packet 60B.

Also, a synchronization sequence may be initiated at the start-up of the escalator, in order to allow each safety device 20 to transmit its OP signal packet 60A in a given time slot within the two-second window T. One such sequence includes, for example, the controller's 40 transmitting (e.g., broadcasting) a synchronization signal packet for a short period. The synchronization signal packet includes, for example, the following portions: Start Transmission, Parity Check, Sync Packet Bits, End Transmission. The Sync Packet Bits portion identifies the packet as a synchronization signal sync packet. Upon receipt of a synchronization signal sync packet, each unit 50, 40 is commanded to transmit after a suitable delay (e.g., 1 sec for device #1, 0.2 sec for device #2, 0.3 sec for device #3) its OP signal packet, e.g., 60A.

Hardware/software to effect a periodic transmission mode is well within the skill of the art in view of the instant disclosure. For example, the unit 32A may include a microprocessor, additional memory, buses, etc., while the XMTR 30 includes components to effect transmissions at multiple frequencies. Suitable instructions and data to effect operation at multiple frequencies and according to FIG. 10 are stored, e.g., in the additional memory (not shown) of the unit 32A and in the memory 42A. To effect the synchronization sequence, the controller 40 is connected to a suitable encoder-transmitter, while each unit 30 is connected to a suitable receiver-decoder (with microprocessor and suitably programmed memory). Each delay is effected by any suitable timer (e.g., suitable software in the memory). See, e.g., *Wireless Networked Communications*, by Bud Bates (1994, McGraw-Hill) pages 112–121 (e.g., TDMA techniques) which are incorporated herein by reference.

Although the invention has been shown and described with respect to various embodiments thereof, it should be understood by those skilled in the art that various changes may be made therein without departing from the spirit of and scope of the invention as defined by other appended claims.

What is claimed is:

1. A control arrangement, comprising:

a detector;

an encoder unit connected to said detector, said encoder unit including means for generating a trigger signal including two unique identifiers, a first of said two unique identifiers corresponding to an identification for an escalator, a second of said two unique identifiers corresponding to an identification for said detector;

a wireless transmitter connected to said encoder unit;

a wireless receiver;

a decoder unit connected to said wireless receiver, for passing only a trigger signal including at least said first or said second of said two unique identifiers;

a portable receiver unit, said portable receiver unit including means for receiving said trigger signal having said two unique identifiers, and means for displaying at least one of said two unique identifiers;

a microprocessor connected to said decoder unit and to a memory, said memory including instructions for generating a control signal in response to said trigger signal passed by said decoder unit;

a motor control unit connected to said processor;

a motor connected to said motor control unit; and a plurality of movable steps coupled to said motor, so that said control signal commands said motor control unit to stop motion of said motor and said steps.

2. An arrangement as claimed in claim 1, wherein said portable receiver unit is a hand-held receiver unit.

3. A control arrangement, comprising:

a detector;

an encoder unit connected to said detector, said encoder unit including means for periodically generating a first trigger signal including at least one unique identifier corresponding to an identification for said detector;

a wireless transmitter connected to said encoder unit;

a wireless receiver;

a decoder unit connected to said wireless receiver, for passing said first trigger signal;

a microprocessor connected to said decoder unit;

a motor control unit connected to said processor;

a motor connected to said motor control unit;

a plurality of movable steps coupled to said motor; and a memory connected to said microprocessor, said memory including instructions for monitoring said decoder unit to detect a presence or an absence of said first trigger signal within at least two consecutive time intervals, for generating an alarm signal if an absence of said first trigger signal is detected within the first interval, and for generating a control signal if an absence of said first trigger signal is detected within the second interval, so that said control signal commands said control unit to stop motion of said motor and said steps.

4. An arrangement as claimed in claim 3, wherein each of said time intervals is approximately two seconds.

5. An arrangement is claimed in claim 3, wherein said encoder unit includes means for generating a second trigger signal including said at least one unique identifier corresponding to said identification for said detector, and wherein said first trigger signal is within a first frequency band and said second trigger signal is within a second frequency band, said second frequency band differing from said first frequency band.

6. An arrangement as claimed in claim 5, wherein said first frequency band is 902 MHZ–928 MHZ and said second frequency band is 2.4 GHZ–2.48 GHZ.

* * * * *